US007195688B2

(12) United States Patent
Schäfer et al.

(10) Patent No.: US 7,195,688 B2
(45) Date of Patent: Mar. 27, 2007

(54) PROCESS AND DEVICE FOR THE MANUFACTURE OF A PRIMARY UNIT PACK OF A WAFER

(75) Inventors: Wolfgang Schäfer, Madison, NJ (US); Ronald Hackbarth, Koblenz (DE); Hans-Dieter Sahm, Ingelbach (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 10/527,930

(22) PCT Filed: Sep. 6, 2003

(86) PCT No.: PCT/EP03/09911

§ 371 (c)(1),
(2), (4) Date: Mar. 16, 2005

(87) PCT Pub. No.: WO2004/026692

PCT Pub. Date: Apr. 1, 2004

(65) Prior Publication Data

US 2006/0048887 A1 Mar. 9, 2006

Related U.S. Application Data

(60) Provisional application No. 60/411,269, filed on Sep. 16, 2002.

(30) Foreign Application Priority Data

Oct. 25, 2002 (DE) ..... 102 49 705

(51) Int. Cl.
*B32B 37/00* (2006.01)

(52) U.S. Cl. ..... 156/247; 156/391; 156/250; 156/510; 156/249; 156/538; 156/253; 156/256

(58) Field of Classification Search ..... 156/247, 156/249, 250, 253, 256, 391, 510, 538
See application file for complete search history.

(56) References Cited

U.S. PATENT DOCUMENTS 4,841,712 A 6/1989 Roou (Continued)

FOREIGN PATENT DOCUMENTS

DE 1876961 8/1963

(Continued)

*Primary Examiner*—Chris Fiorilla
*Assistant Examiner*—Kim McClelland
(74) *Attorney, Agent, or Firm*—D. Peter Hochberg; Sean Mellino

(57) ABSTRACT

A process and device for manufacturing a primary unit pack of a wafer. A laminate comprising a carrier sheet and an active substance film is cross-cut at a predetermined length, detached from the carrier sheet, guided between two packaging material webs and, conveyed to a sealing station along with the packaging material webs. The packaging material webs are sealed to form a bag that is separated from the webs. The process includes detaching the carrier sheet from the active substance film, pulling the carrier sheet forward over the predetermined length of the wafer, simultaneously guiding the active substance film, which has been detached from the carrier sheet, without mechanical stress, the front end being between the packaging material webs which are in a resting condition, and is received and fixed by packaging material webs and transversely cut to form a wafer.

7 Claims, 2 Drawing Sheets

U.S. PATENT DOCUMENTS 5,182,128 A * 1/1993 Laplace ..... 426/410
5,985,088 A * 11/1999 Couillard et al. ..... 156/324
6,655,112 B1 12/2003 Cremer et al.

FOREIGN PATENT DOCUMENTS

DE 1895537 6/1964
DE 19800682 7/1999
EP 0744341 11/1996
FR 1384181 1/1965

* cited by examiner

PROCESS AND DEVICE FOR THE MANUFACTURE OF A PRIMARY UNIT PACK OF A WAFER

CROSS REFERENCE TO RELATED APPLICATIONS

This application is a National Stage application of International Application No. PCT/EP03/09911, filed on Sep. 6, 2003, which claims priority of German application number 102 49 705.2, filed on Oct. 25, 2002 and claims the benefit of U.S. Provisional Application No. 60/411,269, filed on Sep. 16, 2002.

BACKGROUND OF THE INVENTION

1. Field of the Invention

The invention relates to a process and a device for the manufacture of a primary unit pack of a wafer, particularly of a wafer that has been separated from an active substance film of one or more active substances for use as a dosage unit and administration form for medicaments.

2. Description of the Prior Art

Apart from the known dosage forms for medicaments, such as tablets, capsules, drops or similar administration forms, there is the administration form of the "wafer". This is a small thin plate of an active substance film comprising a predetermined amount of active substance and with a thickness and dimensions adapted according to the amount of active substance to be delivered. A wafer is flexible, soft, of small weight and can be torn. Since there is a direct correlation between the contact surface of the wafer and the dosage amount of the active substance, the dimensions of the wafer must be identical to the greatest possible extent with the dimensions calculated, and must lie within the range of tolerance. Because the dosage is dependent on the surface area, the soft active substance material must not be stretched prior to cutting since otherwise the amount of active substance would be changed. For this reason, the manufacture of the wafer and the packaging of a single wafer or the packaging of several wafers in a primary pack unit is costly.

From DE 198 00 682 A1, a process is known for manufacturing a primary pack unit for film-like or wafer-like administration forms (wafers) for oral application, comprising one section of an upper packaging material web and one section of a lower packaging material web. When applied to square or rectangular wafers, the course of this process—which is in principle also applicable to unit packs of wafers—is different from that of the manufacture of wafers of another shape. For square or rectangular wafers, the first step is to convey an upper packaging material web and a lower packaging material web, without cold or hot forming, on top of one other via respective deflecting shafts, while the film-like or wafer-like administration form is simultaneously conveyed between the two webs of packaging material by means of rollers or gripper feed systems. In this process, it is also possible to feed an active substance film in the form of a web material—single-webbed or multi-webbed, parallel and spaced at a distance from one another—with the desired width of the dosage units. Subsequently, dosage units are singled out from the web-shaped active substance film by means of a cross-cutting apparatus which is positioned immediately in front of the deflecting shafts. In a further process step, the two webs of packaging material are sealed together with the help of a heated sealing tool in such a way that the single dosage units are sealed into compartments and are completely enclosed by sealed seams or sealed areas. In further process steps, perforations are punched between the compartments and primary pack units are partitioned off.

For wafers which are to have a shape other than square or rectangular, the process for the manufacture of the primary package unit according to DE 198 00 682 A1 is configured as follows: In a first process step, a laminate of the web-like active substance film and a carrier sheet is provided, out of which the dosage units are punched with a punching device in a further process step without punching through the carrier sheet. The partially punched laminate is subsequently rerouted over an edge or a deflecting shaft with the help of roller feed or gripper feed systems so that the dosage units thereby become detached from the carrier sheet. If necessary, an additional stripping device can be used for this purpose. Thereafter, an upper web of packaging material and a lower web of packaging material without cold or hot forming are conveyed on top of one another by means of respective deflecting shafts, whereby the dosage units becoming detached from the carrier sheet are simultaneously conveyed between the two webs of packaging material. Subsequently, the two webs of packaging material are sealed together with the help of a heated sealing tool in such a way that the single dosage units are sealed into compartments and are completely enclosed by sealed seams or sealed areas. In further process steps, perforations are punched between the compartments and primary packaging units are partitioned off. It goes without saying that this process can also be applied to the manufacture of square or rectangular wafers and the packaging thereof in primary unit packs.

Also known from the aforementioned DE 198 00 682 A1 are devices for carrying out the respective processes. One of these devices has a supply device for a laminate made up of an active substance film and a carrier sheet, a cutting or punching device for the active substance film for punching a wafer on the carrier sheet, a separating tool for detaching the active substance film from the carrier sheet, a pulling device for the carrier sheet, and thereby also for the active substance film with the wafer, a packaging material feeding and packaging material pulling device for two webs of packaging material which receive the respective wafer, a heated sealing tool for the packaging material, and a cutting tool for separating the sealed pouch.

The wafer material is elastic and may, as a consequence of the mechanical stress occurring when it is transported between the upper packaging material web and the lower packaging material web, change its shape and its dimensions. There is also a risk that the amount of active substance in the single wafer will change since the area of the wafer is decisive for dosing the active substance. With the above described processes it is not possible to ensure the required constancy of the active substance amount since the wafer material is in each case subjected to mechanical stress prior to being inserted between the packaging material webs.

SUMMARY OF THE INVENTION

It is an object of the present invention to configure an improved process and device for the manufacture of a primary unit pack of a wafer, such that the wafer material is not subjected to mechanical stress.

It is another object of the present invention to provide a process and device for manufacturing a primary unit pack of a wafer that has been separated from an active substance film having at least one active substance and where the wafer may be used as a dosage unit and administration form for medicaments.

The process according to the present invention comprises providing a laminate made up of a carrier sheet and an active substance film to be pulled off, the carrier sheet becoming detached from the active substance film in the process and being separately wound up. Due to the forward motion of the carrier sheet, the active substance film is also moved forward. With its front end, the active substance film is conveyed, without mechanical stress, between two resting packaging material webs, is fixed by said packaging material webs and in order to produce the wafer is crosscut at a predetermined rearward distance from the packaging material webs. Subsequently, the wafer, which is fixed between the packaging material webs, is pulled forward, together and synchronously with said webs, whereby the pulling force acts on the packaging material webs, and is fed to a sealing station. In this sealing station, the packaging material webs are sealed, outside of the area where the wafer is placed, to form a pouch or bag which is subsequently separated from the packaging material webs.

The laminate is produced in a known manner by using a coating process, and is subsequently cut into strips which are coiled up. The width of a coil corresponds to the width of the desired wafer or to a multiple of said width of the wafer. If a plurality of wafers is cut from the coil, the individual wafers are spread out so as to be arranged over the width necessary for inserting them in the packaging material webs. The coil is provided as a supply coil. An advantage of this process is that the wafer is conveyed and guided without mechanical stress. The process is carried through in such a way that the respective length by which the carrier sheet, and thereby also the active substance film, is pulled forward corresponds to the desired length of a wafer, so that the wafers can be reproduced in an extremely precise manner and are always the same. As a consequence, each wafer also has the same active substance dose. Thereafter, the single wafer is fixed over its entire extent between the packaging material webs while said webs are being pulled forward, and it is not subjected to mechanical stress in the process. When the packaging material webs are sealed to form a bag, there is no risk of damaging the wafer fixed between said webs. The process is easily accomplished.

In one embodiment of the present invention, the active substance film, which has been detached from the carrier sheet, is conveyed in a vertical orientation between the packaging material webs, which in this process step are in a resting condition and are arranged at a distance from each other. The packaging material webs are subsequently put against the wafer and are pulled forward on both sides of the active substance film, at the same speed of pulling and in the same direction of pulling so that the active substance film between the packaging material webs is pulled forward along with them without being subjected to mechanical stress. At the infeed of the active substance film the packaging material webs are guided through a clamping device which presses the packaging material webs against the wafer and fixes them; this takes place at the end of the work cycle, during which the active substance film has been placed with its front end between the packaging material webs. A relative motion between the wafer and the webs of packaging material is thus impossible. In this position, the active substance film is crosscut at a predetermined distance from the clamping station in order to separate a wafer, and in the next operational step is drawn between the packaging material webs and pulled forward along with them, completely and without being subjected to stress.

The device for carrying out the process comprises, in a known manner, a supply device for the laminate. The laminate is formed of a carrier sheet and an active substance film. The device for carrying out the process also comprises a separating tool for detaching the active substance film from the carrier sheet; a pulling device for the carrier sheet and thereby for the active substance film as well; a cutting tool for the active substance film; a device for feeding the packaging material and pulling it forward, for two packaging material webs, which may be taken from a packaging material roll and be separated by a separating method and deflected; a heated sealing tool for the packaging material; and a cutting tool for separating the finished side-sealed bag. In accordance with one embodiment of the invention, the device for feeding and pulling the packaging material is provided with a receiving and clamping device for the front end of the active substance film, which device is arranged in vertical direction below the separating tool for detaching the active substance film and below the cutting tool for said active substance film, in such a way that during a feed cycle the active substance film, which has been detached from the carrier sheet, moves downwards in vertical direction into the receiving and clamping device. During this process the active substance film is not subjected to mechanical stress.

The receiving and clamping device is formed of clamping rolls between which the packaging material webs are guided under tension and which are movable in a horizontal direction, and thereby transversely to the direction in which the active substance film is pulled forward, in opposite direction to each other, between a receiving position for receiving the active substance film and a clamping position for clamping the active substance film. To form an infeed funnel for the active substance film, two pairs of clamping rolls may be arranged one above the other.

BRIEF DESCRIPTION OF THE DRAWINGS

In the following, the invention will be explained by means of an example of an embodiment. The accompanying drawings are schematic representations of the present invention.

DETAILED DESCRIPTION OF THE INVENTION

Figure 1:
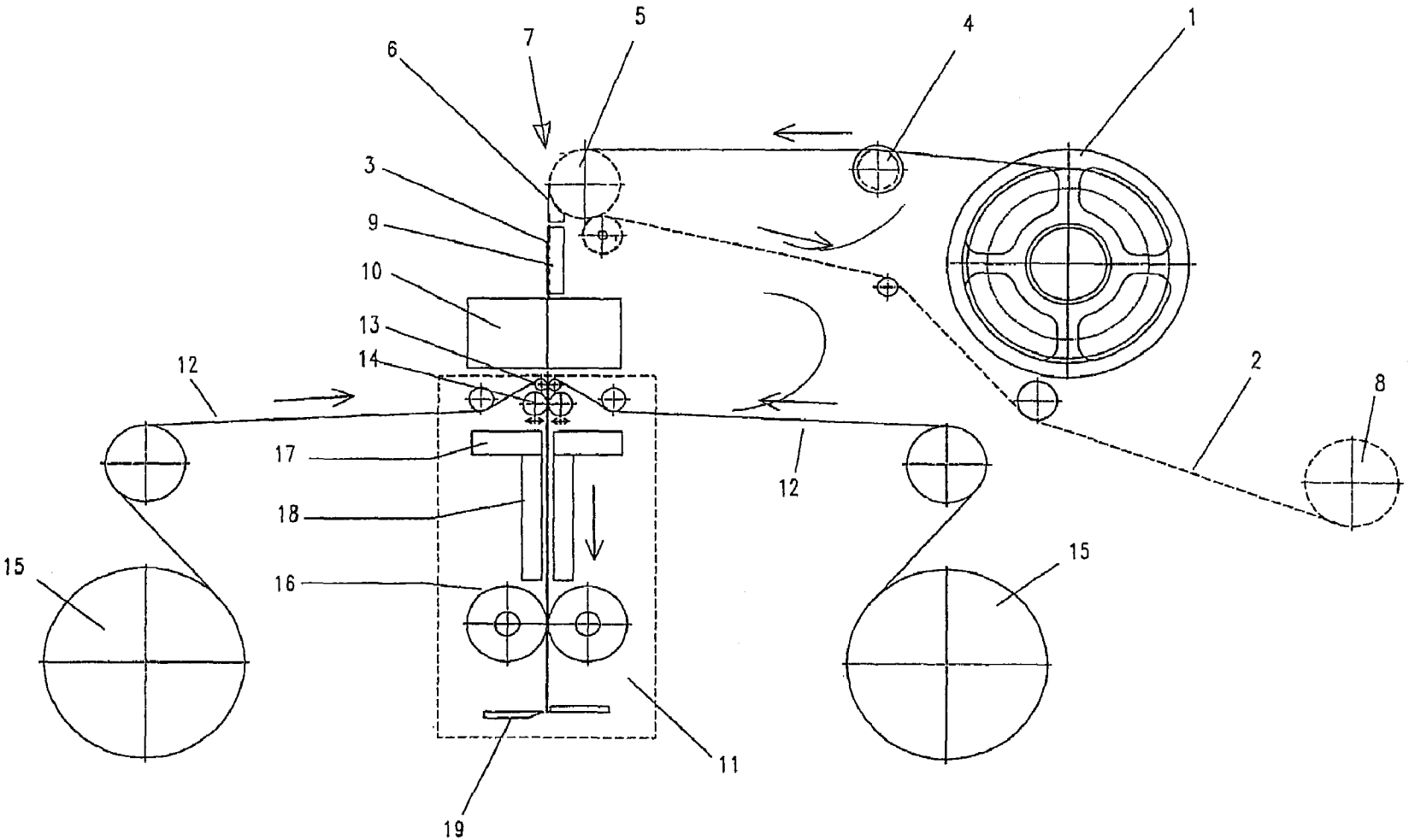
FIG. 1 is a schematic drawings of the device of the present invention for the manufacture of a primary unit pack of a wafer.

The device shown in FIG. 1 is provided at its entry side with a supply roll 1 with a laminate 4, made up of a carrier sheet 2 and an active substance film 3, which is to be pulled forward; a deflecting roll 5 and a stripping device 6 for detaching the active substance film 3 from the carrier sheet 2; and a coil 8 for winding up the carrier sheet 2. A separating roll 7 is provided, below which guide paths or guide bars 9 are arranged for exact alignment of the active substance film 3, which has been detached from the carrier sheet 2. Also arranged below separating roll 7 are a crosscutting device 10 with a knife (not shown), and a device 11 for feeding and pulling the packaging material, for two packaging material webs 12. Device 11, on the side of the cutting device, has a receiving and clamping device formed of two pairs of clamping rollers 13 and 14 which are arranged one above the other. The packaging material webs 12 are arranged on supply rolls 15 and are guided via the clamping rollers 13 and 14 to the pulling rolls 16, by which material webs 12 are fixed by clamping and pulled forward. As a result, material webs 12 are also lying, under tension, on the clamping rollers 13 and 14. Between clamping rollers 13, 14 and pulling rolls 16 heated cross-sealing and longitudinal-sealing tools 17 and 18 are arranged. In the direction of pulling, following the pulling rolls 16, a flat knife 19 is provided as a cutting device.

Figure 3:
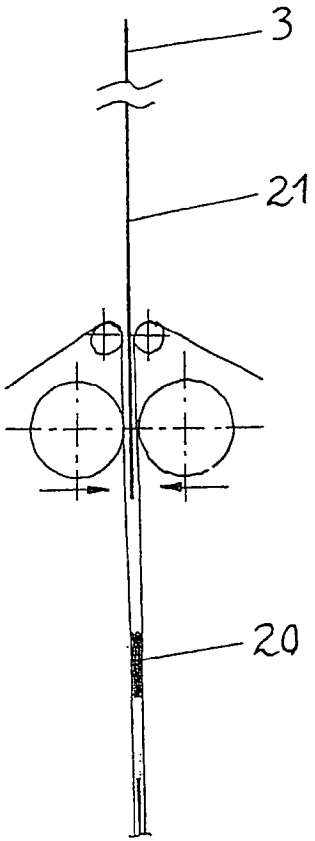
Figure 2:
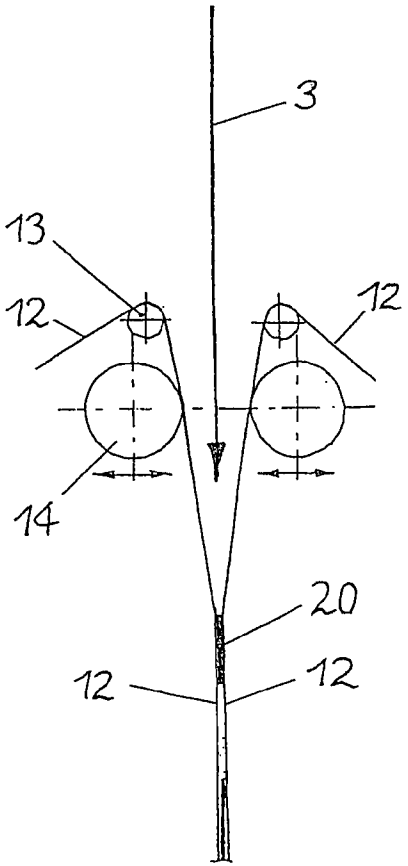

To manufacture a primary unit pack of a wafer, a laminate 4, which has the predetermined width of the wafer, is drawn off, by the predetermined length of the wafer, from the supply coil 1 by actuating the coil 8. In this process, the active substance film 3 is removed from the carrier sheet 2 by the separating roll 7, and is oriented downwards in a vertical direction by the guide paths or guide bars 9. Guide paths or bars 9 do not possess any clamping function for clamping the active substance film 3. In this process, the front end of the active substance film 3 moves between the clamping rollers 13 and 14, which are in a receiving position at a distance from each other and along which on the side of the active substance film the packaging material webs 12 are guided and, in the receiving position, rest against rollers 13, 14 under tension. In the preceding cycle, the packaging material webs 12 are provided with a transverse sealed seam 20 (FIGS. 2 and 3) which now forms the front or bottom seam of the side-sealed bag, that is, of the primary unit pack of the wafer which is being produced. This process step is depicted in FIG. 2.

Figure 5:
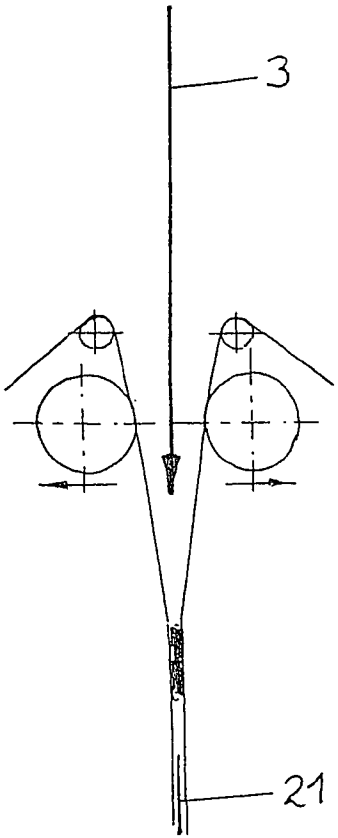
FIGS. 2 to 5 are exploded schematic drawings of a receiving and clamping device of the present invention for the manufacture of the wafer, shown in successive process steps.
Figure 4:
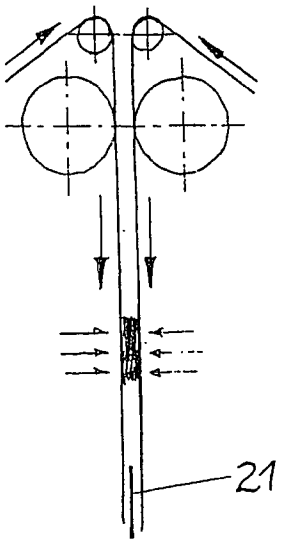

In the next process step (FIG. 3) the packaging material webs 12 are pressed by clamping rollers 13, 14 against the front region of the active substance film 3 which has been pulled forward and active substance film 3 is fixed between the packaging material webs 12 by movement of rollers 13, 14 towards each other. A wafer 21 of the predetermined length is now separated from the active substance film 3 by the crosscutting device 10. Thereafter, the packaging material webs 12 are pulled forward, along with the wafer clamped between them, by synchronous actuation of the pulling rolls 16, to the position of the rearward transverse sealed seam 20 (FIG. 4), the wafer 21 being moved free of friction and at the same speed as the packaging material webs 12. In this position the packaging material webs 12 are heat-sealed with each other on the two longitudinal sides by the two longitudinal-sealing tools 18 and on the rearward transverse side by the transverse-sealing tool 17. The width of the resulting transverse sealed seam 20 is selected such that it can be divided crosswise and forms both the sealed seam of the primary unit pack which has just been manufactured, but which has yet to be separated, and the front or bottom seam of the following unit pack. After sealing, the clamping rollers 13, 14 are moved back to their receiving positions and are thereby opened. This process step is shown in FIG. 5. The next cycle again starts with inserting the active substance film between the clamping rollers 13 and 14, which are in the receiving position, as described above. After each cycle, a primary unit pack 22 of a wafer 21—which unit pack has been manufactured in the above-described manner—is separated by the flat knife 19 from the following unit pack.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

The invention claimed is:

1. A process for manufacturing a primary unit pack of a wafer, the wafer having a predetermined length and a predetermined width, the process comprising the following steps:

providing a laminate comprising a carrier sheet and an active substance film being detachably connected to said carrier sheet and having a front end;

providing two packaging material webs;

partially detaching said active substance film from the carrier sheet; pulling said carrier sheet forward, and thereby also the active substance film, forward over the predetermined length of the wafer that is to be produced;

while pulling said carrier sheet forward, simultaneously guiding said detached active substance film, with its front end first, between said two packaging material webs while these webs are in a resting condition, without subjecting said active substance film to a mechanical stress, and whereby the active substance film is fixed between said two packaging material webs;

after guiding said detached active substance film between said two packaging material webs, transversely cutting said active substance film at a distance from said two packaging material webs to form a wafer of the predetermined length;

pulling the wafer forward together and synchronously with said two packaging material webs while the wafer is fixed between these webs;

conveying the wafer and said two packaging material webs forwardly to a sealing station;

sealing the packaging material webs outside of the area of the wafer to form a pouch or bag enclosing said wafer; and separating said pouch or bag from the packaging material webs.

2. The process according to claim 1, further comprising the steps of guiding the active substance film in a vertical alignment between said two packaging material webs and feeding said two packaging material webs in on both sides of said active substance film.

3. The process according to claim 1, wherein the step of detaching said active substance film from the carrier sheet comprises the step of detaching the active substance film from the carrier sheet on a device selected from the group consisting of an edge and a deflecting roll.

4. The process according to claim 3, wherein the step of detaching said active substance film from the carrier sheet comprises the step of arranging a stripping device between the active substance film and the carrier sheet.

5. The process according to claim 1, wherein the steps of pulling the carrier sheet and guiding the detached active substance film between said two packaging material webs comprise the further steps of guiding said two packaging material webs over a clamping device during the separating of the wafer from the active substance film by transverse cutting and during the forward conveying of said two packaging material webs and pressing said two packaging material webs against the active substance film to prevent relative motion between the wafer and the packaging material webs by means of said clamping device.

6. A device for manufacturing a primary unit pack of a wafer, said device comprising:

a supply device for a laminate including an active substance film having a front end and a carrier sheet;

a separating roll for detaching the active substance film from the carrier sheet;

a pulling device for the carrier sheet and for the active substance film a crosscutting device for cutting the active substance film;

a device for feeding and pulling two packaging material webs, said device comprising a receiving and clamping device for the front end of the active substance film comprising at least one pair of clamping rollers, said receiving and clamping device being arranged in a vertical direction below the separating roll and below the crosscutting device, said two packaging material webs being conveyed between said at least one pair of clamping rollers, said at least one pair of clamping rollers being movable between a receiving position and a clamping position for receiving and securing the active substance film, and being transversely movable relative to each other and in an opposite direction relative to each other;

a heat sealing tool for sealing the packaging material to form a side-sealed bag; and a cutting device for separating the side-sealed bag from the packaging material web.

7. The device according to claim 6 wherein two pairs of clamping rollers are arranged one above the other.

* * * * *